United States Patent [19]

Romer-Nygaard

[11] Patent Number: 4,813,168

[45] Date of Patent: Mar. 21, 1989

[54] NOTICE BOARD

[76] Inventor: Lars Romer-Nygaard, Oresundshoj 3 B, Charlottenlund, Denmark, 2920

[21] Appl. No.: 26,582

[22] Filed: Mar. 17, 1987

[30] Foreign Application Priority Data

Mar. 18, 1986 [DK] Denmark ..... 1256/86

[51] Int. Cl.[4] ..... G09F 7/04

[52] U.S. Cl. ..... 40/621; 40/622

[58] Field of Search ..... 40/621, 622, 600, 152; 434/428, 430; 428/455, 900

[56] References Cited

U.S. PATENT DOCUMENTS

| | | | |
|---|---|---|---|
| 641,283 | 1/1900 | Evans | 434/430 |
| 3,456,373 | 7/1969 | Epton | 428/900 |
| 4,584,223 | 4/1986 | Krapf | 434/430 |

FOREIGN PATENT DOCUMENTS

| | | | |
|---|---|---|---|
| 1806045 | 5/1970 | Fed. Rep. of Germany | 40/621 |
| 2514525 | 10/1975 | Fed. Rep. of Germany | 40/622 |
| 138742 | 2/1920 | United Kingdom | 40/622 |

*Primary Examiner*—Robert P. Swiatek
*Assistant Examiner*—Cary E. Stone
*Attorney, Agent, or Firm*—Darby & Darby

[57] ABSTRACT

In order to use pins (6) as well as magnets (7) for hanging pieces of paper (5) on a notice board, this is provided with an iron plate (1) in which holes (2) are punched, and where a fibreboard (3) is provided behind the plate (1). Hereby magnets (7) will be able to stick to the iron plate (1), while pins (6) can be stuck into the soft plate (3) opposite a hole (2).

A back plate (10) provided behind the soft plate (3) can together with a frame (4), attached along the side edges of the plates (1 and 10), close the construction and make this rigid and deformation resistant.

5 Claims, 2 Drawing Sheets

NOTICE BOARD

The invention relates to a notice board comprising an iron plate which can be secured to a frame enabling the iron plate to be hung on a wall.

Notice boards of this type are used everywhere, where sheets of paper, pictures or the like are to hang on a board in a releasable manner by means of magnets which stick to the iron plate through the paper.

Magnetic suspension is expedient for many purposes of suspending, but a more permanent fastening requires one or more pins which can "nail" the paper to the notice board.

Naturally, this cannot be done on the known magnetic notice boards, just as a magnetic suspension cannot take place on a soft plate used for fastening objects by means of pins.

It is the object of the invention to overcome these drawbacks by the known suspension systems, and this is achieved by means of a notice board of iron which is provided with one or several holes. and in that a soft material which will hold inserted pins is fitted behind the holes end in their entirety.

In this surprisingly simple manner paper may be held either by means of magnets only, by means of pins only, or by a combination of magnets and pins. The latter provides a hitherto unknown opportunity of hanging objects in which it is possible to "turn over the leaves", since magnets can easily be removed in order that the sheet or sheets can be folded away from the fastening pin.

These possibilities provide a hitherto unknown wide range of application purposes, because the shape of the holes can be used to form patterns with decorative or advertising value. Moreover, new effects can be achieved by making a suitable choice of colour for the iron plate and the soft material. In this manner text can be shaped by means of this relief/contrast difference between the iron plate and the soft material.

By, as referred to in claim 2, using a soft fibre-board or the like, the production of the board can be simplified and the board will become deformation-resistant.

By, as referred to in claim 3, providing the back with an even plate, this may be used for instance as top surface for magnets or as writing surface for text markers or the like, when the plate faces outwards.

Finally it is expedient, as referred to in claim 4, to fit a frame profile extending along the side edges, because this facilitates the assembly of the plate and any adjacent boards and makes it easy to hang the notice board on the wall.

Figure 1:
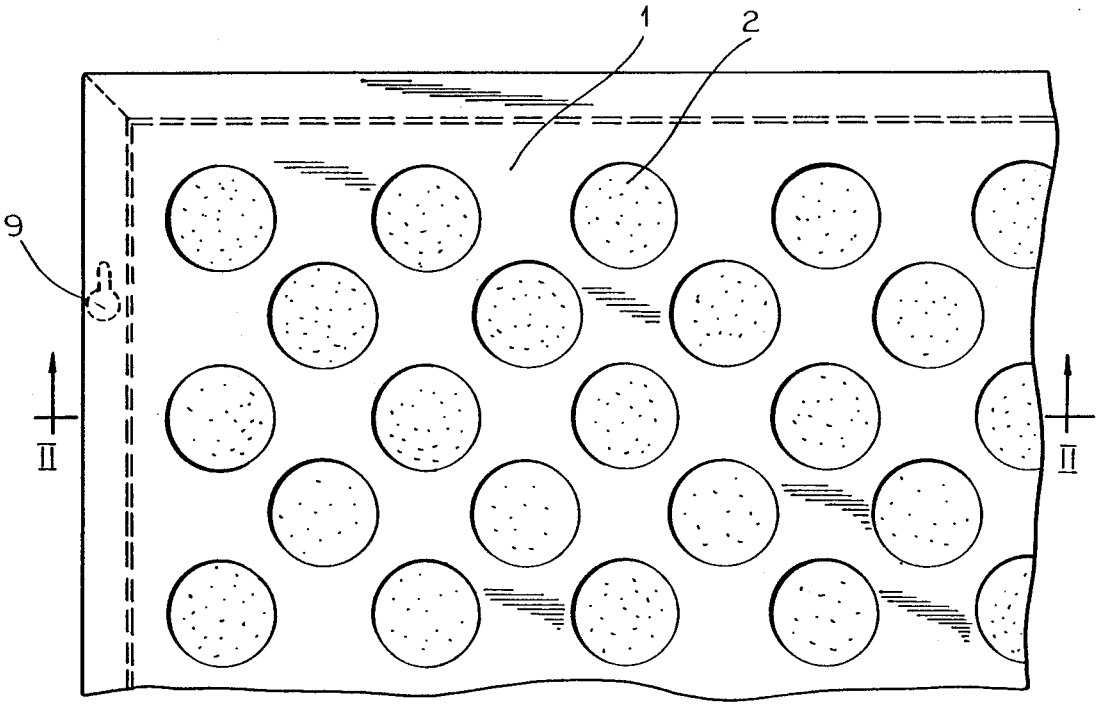
Figure 2:
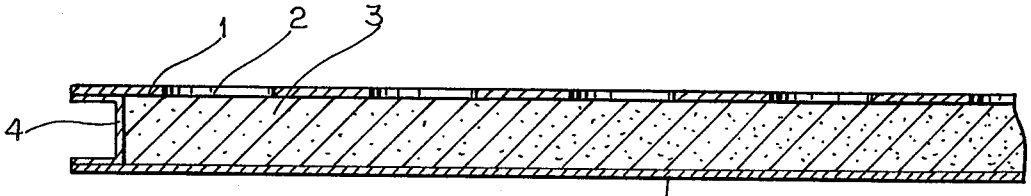
Figure 3:
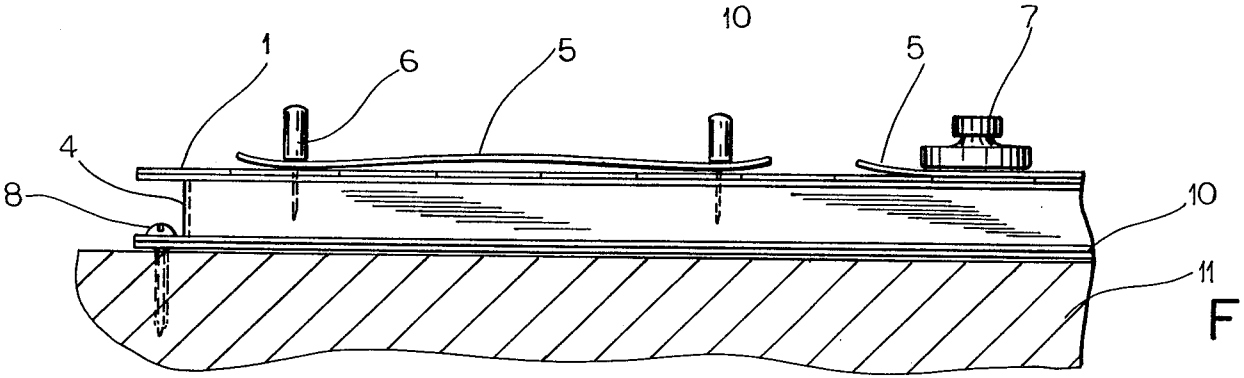
Figure 4:
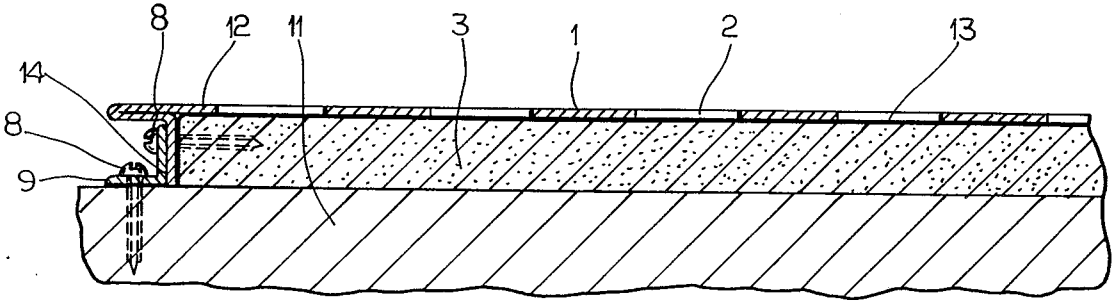

In the following the invention will be described in closer detail with reference to the drawing, in which FIG. 1 is a front section of a board, FIG. 2 shows the board seen along II—II in FIG. 1, FIG. 3 is a top view of the board, attached to a wall, and FIG. 4 is a cut through another embodiment.

In FIGS. 1–3 is shown an example of a first embodiment of the invention, i.e. in the shape of a rectangular notice board with back plate.

The actual notice board comprises at the outside an iron plate 1 provided with circular holes 2 evenly distributed over the entire iron plate 1.

Behind the iron plate 1 there is a soft plate 3 of a fibre material or the like suited for holding an inserted pin 6, as shown in FIG. 3.

Finally there is an even board 10 which forms the back board, and whose surface may be of such a nature that it is possible to write on it with a text marker or the like.

Along the side edges of the notice board there is mounted a U-shaped frame profile 4 with flanges standing at right angles, to which the front and back plates 1 and 10 are glued or perhaps spot welded.

Hereby is produced a completely closed construction which is both sturdy and simple.

In the frame profile 4 holes 9 may be provided for screws 8 in order that the board can be hung on a wall 11, as shown in FIG. 3.

In FIG. 4 is seen an example of a second embodiment without back plate. The iron plate 1 with holes 2 is along the sides folded to form a rim 12 facing backwards and extending along the sides, in which rim the soft plate 3 is mounted. In the shown example there is moreover laid in a piece of cloth 13 between the iron plate 1 and the soft plate 3. This piece of cloth may be coloured in order to give a decorative effect.

The hanging of the board on a wall 1 can be effected by means of a suitable number of angle hinges 14 attached to the folded rim 12 and being provided with a hole 9 for a screw 8 which is screwed into the wall 11.

When the notice board is used, pins 6 can be inserted opposite the holes 2 or magnets 7 can be placed on the iron plate 1. Hereby it becomes possible to stick all usual types of sheet-like items 5 to the board in a releasable and yet reliable manner.

In the shown embodiment the holes 2 in the iron plate 1 are circular, but it is of course possible to use any other type of hole shapes for the formation of patterns, text, logo or the like. Add to this the opportunity of providing the surface of the soft plate 3 opposite the holes 2 with text, pictures or colours in order to emphasize the holes 2.

In stead of a frame 4 for hanging the notice board on a wall or the like, the notice board may be incorporated in other frames to form furniture elements, such as panelling, doors, gables, partition walls, or the like. Hereby the advantage of a fastening qualitities can be combined with a furniture or building part, a combination of purposes which has so far not been possible.

What is claimed is:

1. A notice board assembly comprising a frame defined by a plurality of peripheral walls, each said wall having a base member with first and second ends, a supporting member contacting said first end and exposed at an angle to the base member, a plurality of said supporting members defining a front surface of the frame, a plate having a plurality of openings going therethrough, said plate contacting said front surface of the frame, said second ends of the base members directly, without any intermediary elements, engaging a supporting surface, an empty space is defined between the supporting surface, the base members and the plate, a soft material is located within the space in such a manner that said soft material directly contacts the supporting surface.

2. A notice board assembly according to claim 1 wherein connecting means is provided for permanent attaching said frame to the supporting surface.

3. A notice board assembly according to claim 2 wherein said connecting means is an angle-shaped member having one side attached to at least one said base member and the other end to the supporting surface.

4. A notice board assembly according to claim 1 wherein the soft material has the shape of the plate and all openings of the plate are covered by the soft material.

5. A notice board assembly according to claim 1 wherein the supporting member is exposed to a base member at a 90° angle.

* * * * *